US008579045B2

(12) United States Patent
Deutsch et al.

(10) Patent No.: US 8,579,045 B2
(45) Date of Patent: Nov. 12, 2013

(54) ROCK DRILLING DEVICE AND DRILL RIG INCORPORATING A DEVICE FOR MEASURING THE LOCATION OF THE DRILLING MACHINE

(75) Inventors: René Deutsch, Örebro (SE); Henrik Ronquist, Örebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 828 days.

(21) Appl. No.: 11/793,260

(22) PCT Filed: Feb. 24, 2006

(86) PCT No.: PCT/SE2006/000243

§ 371 (c)(1),
(2), (4) Date: Jun. 18, 2007

(87) PCT Pub. No.: WO2006/098673

PCT Pub. Date: Sep. 21, 2006

(65) Prior Publication Data

US 2008/0110676 A1 May 15, 2008

Related U.S. Application Data

(60) Provisional application No. 60/661,003, filed on Mar. 14, 2005.

(30) Foreign Application Priority Data

Mar. 14, 2005 (SE) ..... 0500568

(51) Int. Cl.
*E21B 47/00* (2012.01)

(52) U.S. Cl.
USPC ..... 175/40; 33/1 H; 33/311

(58) Field of Classification Search
USPC ..... 175/40, 45; 33/1 H, 301, 302, 304, 306, 33/311–313, 613, 624, 525, 544.1, 544.2, 33/544.3, 503, 504, 505, 544
See application file for complete search history.

(56) References Cited

U.S. PATENT DOCUMENTS 3,613,804 A * 10/1971 Jonsson ..... 173/49
3,643,504 A * 2/1972 Rundell ..... 73/152.49

(Continued)

FOREIGN PATENT DOCUMENTS

WO 2004 074626 9/2004

*Primary Examiner* — William P Neuder
*Assistant Examiner* — Elizabeth Gitlin
(74) *Attorney, Agent, or Firm* — Mark P. Stone

(57) ABSTRACT

A rock drilling device comprising a feed beam (4), which has a drill end (41) from which the drill point protrudes at drilling and a rear end(42) opposite the drill end; a rock drilling machine (5) movable along the feed beam (4); a pressure cylinder (6), which is arranged in connection with the feed beam (4) with one end (622) movable relative to the feed beam (4) and one end (611) fixedly arranged relative to the feed beam (4). The pressure cylinder (6) drives a feed line (51) for feeding the drilling machine (5) to and fro along the feed beam (4). The feed line (51) is routed over two outer sheaves (52, 53) that are arranged at each end (41, 42) of the feed beam (4) and a measuring device (7) for measuring the location of the drilling machine (5) relative to the feed beam (4) is arranged to the shaft (9) of one of the sheaves (52, 53) and the sheave and the shaft (9) are arranged such that they rotate together.

20 Claims, 2 Drawing Sheets

(56) References Cited

U.S. PATENT DOCUMENTS 3,747,218 A * 7/1973 Bell ..... 33/734
3,973,634 A * 8/1976 Persson et al. ..... 173/147
4,736,297 A * 4/1988 LeJeune ..... 702/9
5,601,148 A 2/1997 Heiskanen et al.
5,844,133 A * 12/1998 Goto et al. ..... 73/152.54
5,934,387 A * 8/1999 Tuunanen ..... 175/45
6,016,878 A 1/2000 Jansson
6,550,544 B1 4/2003 Saf

* cited by examiner

ROCK DRILLING DEVICE AND DRILL RIG INCORPORATING A DEVICE FOR MEASURING THE LOCATION OF THE DRILLING MACHINE

The present patent application claims the benefit of U.S. Provisional Patent Application No. 60/661,003, filed on Mar. 14, 2005, pursuant to 35 U.S.C. 119 (e).

TECHNICAL FIELD OF THE INVENTION

The present invention relates to a drilling device, in accordance with the preamble of the independent claim. The invention also relates to a drill rig comprising such a drilling device.

BACKGROUND OF THE INVENTION

On a drill rig it is important to know the exact location of the drilling machine along the feed beam. This serves two purposes, firstly it indicates at what depth the drill bit is located and secondly it helps the operator when manoeuvring the drilling machine, for instance when a drill rod is added to the drill string.

Generally, a rock drill rig (see FIG. 1) comprises a movable carrier 1, a boom 2 and a feed beam 4 connected to the boom 2 via e.g. a feed beam holder 3. The feed beam and the feed beam holder are movable in relation to each other along at least part of the length of the feed beam, which permits relative movement between the feed beam and the boom. A drilling machine 5 is movably arranged on the feed beam.

It has proven advantageous to use a hydraulic cylinder or a pressure cylinder for moving the drilling machine along the feed beam as it provides a reliable and steady feeding.

A problem that arises when a pressure cylinder is used as feed engine is the placement of a measuring device.

U.S. Pat. No. 6,550,544 B1 discloses a rock drilling device, in which a pressure cylinder is used for moving the drilling machine along the feed beam. In this arrangement a feed line is routed over a sheave that is arranged at a movable end of the pressure cylinder. A separate measuring device is arranged to measure the movement of the outer end of the pressure cylinder, which corresponds to half the movement of the drilling machine. The measuring device comprises a wire that is routed over a wheel, which is connected to a sensor that registers the rotation of the wheel. This arrangement, which is used today, has two main problems. Firstly it is not always accurate enough since the wire slides around the wheel, and secondly the wire and the wheel may be subjected to mechanical efforts, which might damage the device.

BRIEF DESCRIPTION OF THE INVENTION

The main object of the present invention is to achieve a simple and reliable way of measuring the location of a pressure cylinder fed drilling machine without the drawbacks presented above. This is solved by the features set forth in the characterising portion of the independent claim.

Preferred embodiments of the invention are set forth in the dependent claims.

According to a main aspect, the present invention relates to a rock drilling device comprising a feed beam, which has a drill end from which the drill point protrudes at drilling and a rear end opposite said drill end; a rock drilling machine movable along the feed beam; a pressure cylinder, which is arranged in connection with the feed beam with one end movable relative to the feed beam and one end fixedly arranged relative to the feed beam. The rock drilling device further comprises a feed line, which is driven by the pressure cylinder and connected to the drilling machine for feeding it to and fro along the feed beam. The feed line passes over two outer sheaves. A measuring device for measuring the location of the drilling machine relative to the feed beam is arranged to the shaft of one of the sheaves and the sheave and the shaft are arranged such that they rotate together.

The solution according to the invention provides a reliable arrangement for measuring the location of the drilling machine that is easy to implement and supervise.

These and other aspects and advantages of the present invention will be apparent from the detailed description and the accompanying drawings.

SHORT DESCRIPTION OF THE DRAWINGS

In the detailed description of the present invention reference is made to the accompanying drawings, wherein.

DETAILED DESCRIPTION

Figure 3:
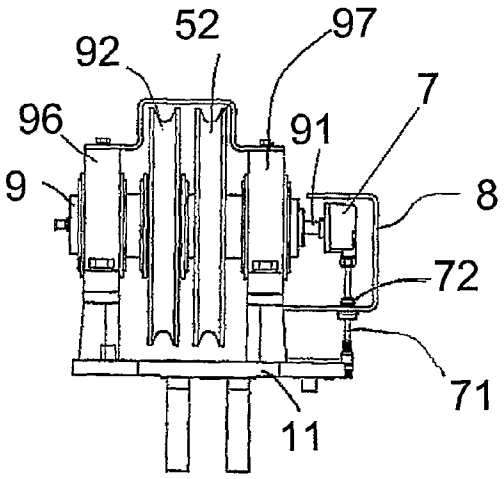
FIG. 3 shows an end view of a measuring device on a shaft arrangement in accordance with the invention.
Figure 1:
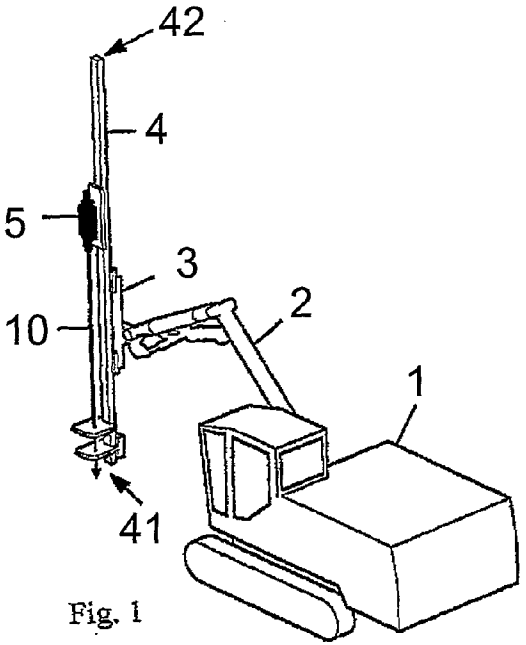
FIG. 1 shows a schematic view of a rock drill rig.

As briefly discussed above, FIG. 1 shows a schematic view of a rock drill rig comprising a movable carrier 1, a boom 2 and a feed beam 4 connected to the boom 2 via a feed beam holder 3. The feed beam 4 and the feed beam holder 3 are movable in relation to each other along at least part of the length of the feed beam 4. A drilling machine 5 is slidably attached to the feed beam 4, and is movable along the feed beam 4. The drilling machine holds a drill string 10, which consists of a drill point (drill bit) and joined rod. The feed beam 4 has a drill end 41 from which the drill point protrudes at drilling, and a rear end 42 opposite the drill end 41.

Figure 2:
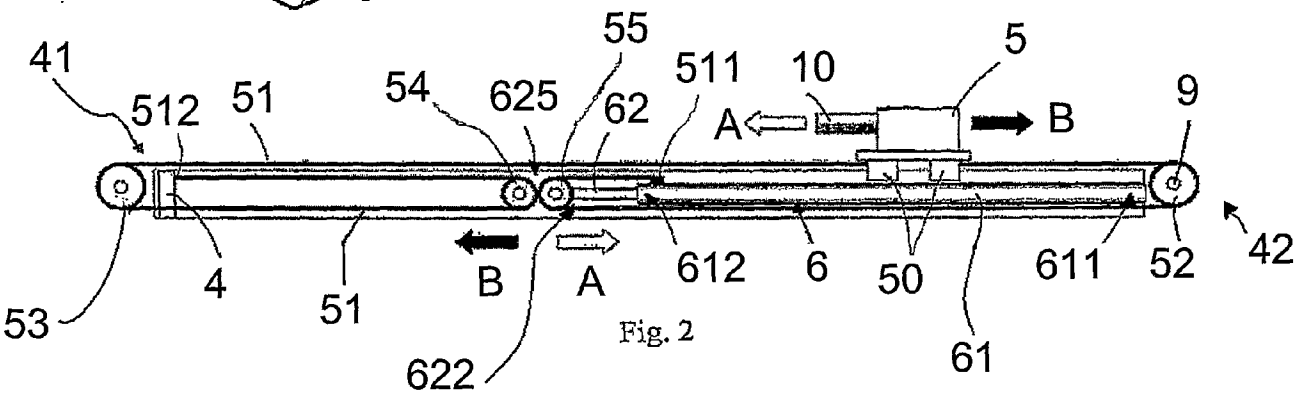
FIG. 2 shows a schematic view of a feed beam with a drilling machine driven by a pressure cylinder.
Figure 4:
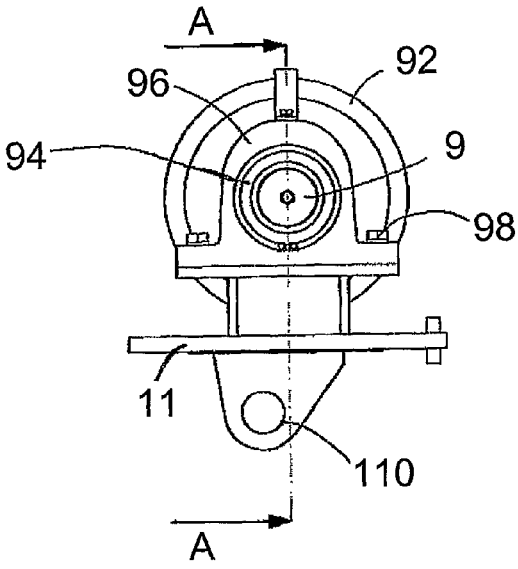
FIG. 4 shows a side view of the shaft arrangement.
Figure 5:
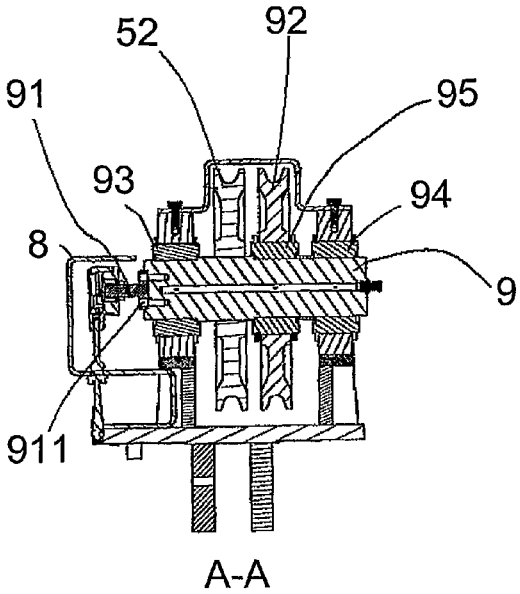
FIG. 5 shows cross sectional view of the shaft arrangement with measuring device along the line A-A in FIG. 4.
Figure 6:
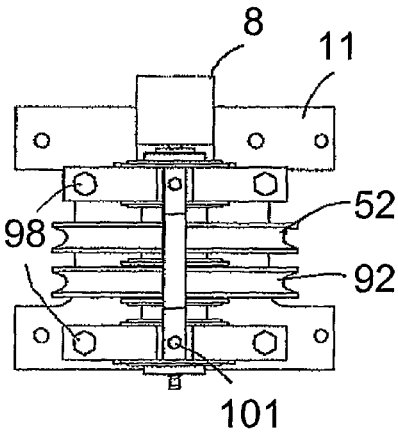
FIG. 6 shows a top view of the shaft arrangement with measuring device.
Figure 7:
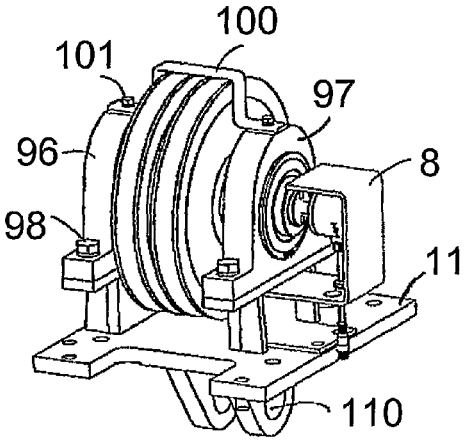
FIG. 7 shows another view of the shaft arrangement with measuring device.

Now with reference to FIG. 2, a pressure cylinder 6 is arranged inside the feed beam 4. The pressure cylinder 6 is adapted to drive the drilling machine 5 to and fro along the feed beam using a feed line 51. The feed line can be a chain or a wire or any other line that is sufficiently strong and unyielding. In the preferred embodiment of this invention a wire is used as feed line. Sheaves 52, 53 are arranged at both ends of the feed beam and the feed line 51 passes over both these sheaves. The drilling machine 5 is slidably arranged on the feed beam 4 via sliding elements 50. The movement of the cylinder and the drilling machine is indicated by arrows A and B.

In practise it may be advantageous to use two feed lines, one at each side of the drilling machine, which are fixed to opposite sides of the drilling machine. However, the number of feed lines does not affect the general arrangement involved in the invention except for the fastening arrangements for fastening the feed line or feed lines to the drilling machine. Suitable fastening arrangements are well known in the art and is not covered by this application.

The pressure cylinder 6 can be of a conventional type involving two cylinders, one outer cylinder 61 and one inner cylinder 62 that slides hydraulically within the outer. The outer cylinder 61 has one outer end 611, which preferably is fixedly arranged to the rear end 42 of the feed beam and one inner end 612, from which the inner cylinder 62 extends.

The inner cylinder 62 has one end inside the outer cylinder at all times. The other end 622 of the inner cylinder is provided with a holder 625 that holds two sheaves 54, 55 over which the feed line 51 passes. A first end 511 of the feed line 51 is fixed to the inner end 612 of the outer cylinder 61 and passes over the closest sheave 55 of the two sheaves arranged on the holder 625 on the inner cylinder to and over the sheave 52 at the rear end, where it exits the feed beam and eventually reaches the drilling machine 5. The feed line 51 continues on the other side of the drilling machine and passes over the sheave 53 at the drill end 41 of the feed beam where it enters the feed beam 4, it then passes over the foremost sheave 54 of the two sheaves on the holder 625 on the inner cylinder, and is routed back towards the drill end 41 of the feed beam where its second end 512 is fixedly arranged. Hence, the feed line is for most parts running inside the feed beam. Generally, the only part of it that runs outside the feed beam is the part where it is attached to the drilling machine, between the two sheaves 52, 53 at the respective ends of the feed beam.

For best performance the feed line is kept completely stretched at all times. With the arrangement used in the preferred embodiment of the present invention the tension of the feed line will not vary as the drilling machine is moved along the feed beam. However, an arrangement for stretching the line is preferably arranged along the line for compensating slacking of the line if any. These arrangements are well known to a person skilled in the art and are not depicted in the drawings.

The two sheaves 52, 53, constitute ideal locations for the placing of a measuring device for measuring the exact location of the drilling machine along the feed beam. With the arrangement according to the invention the measuring device can be placed at either one of the outer sheaves. However, in the preferred embodiment, as indicated in FIG. 2, the measuring device 7 is placed at the rear end 42 of the feed beam. It is advantageous to arrange the measuring device at this end as it is not exposed to such extreme conditions as the drill end 41.

FIGS. 3-7 shows how the sheave 52 is arranged on a shaft 9. The sheave 52 is fixed to the shaft 9 such that the shaft and sheave rotate together. There is in other words no bearing between the shaft 9 and the sheave 52. Instead two bearings 93, 94, one at each end of the shaft, hold the shaft such that it may rotate around its axis. With this arrangement the measuring device 7, which may be of any conventional type, may be arranged to a shaft extension 91. The shaft extension may be attached to the shaft 9, with e.g. screws 911 as in the preferred embodiment, or may form part of the shaft. The bearings 93, 94 are arranged inside housings 96, 97 that are attached to a holding device 11 via two bolts 98. The holding device 11 in turn has openings 110 for attachment to the pressure cylinder 6. A second sheave 92, over which a second feed line (not shown) passes, is arranged on the shaft 9. This second feed line feeds a "hose cradle" (not shown) to which hydraulic hoses for the drilling machine are attached. The second sheave 92 is arranged on an individual bearing 95 so that it can rotate independently of the shaft 9 and the sheave 52 over which the feed line 51 for the drilling machine 5 passes.

The measuring device is shielded by a bent protection plate 8. A cable that leads the signals from the measuring device passes through the bent protection plate 8. The measuring device is generally so light and sensitive that no other holding device is needed. It rotates with practically no friction at all, while the attachment 72 of the cable 71 provides sufficient counter-action to keep it from rotating as the shaft rotates. A conventional measuring device arranged in this manner provides a well sufficient accuracy. The error range has proven to be about 2 millimeters over the 7 meter beam, and for most applications it is, sufficient with an accuracy of 5 millimeters over the 7 meters. The length of the feed beam may vary according to the specific application, but is in most cases between 5 and 10 meters.

A guard member 100 is provided to help keep the feed line 51 for the drilling machine and the feed line for the hose cradle (not shown) in place. The guard member is attached to the housings 96, 97 with screws 101. It may be advantageous to use two or three guard members or one semicircular guard member that covers a greater part of the sheaves. However, as the wire is kept stretched at all times it is unlikely to slide of the sheaves.

The invention claimed is:

1. Rock drilling device comprising a feed beam (4), which has a drill end (41) from which a drill point protrudes at drilling and a rear end (42) opposite said drill end; a rock drilling machine (5) movable along the feed beam (4); said rock drilling machine having a drill string comprising a plurality of drill rods; a pressure cylinder (6), which is arranged in connection with the feed beam (4) with one end (622) movable relative to the feed beam (4) and one end (611) fixedly arranged relative to the feed beam (4); a feed line (51), which is driven by the pressure cylinder (6) and connected to the drilling machine (5) for feeding the drilling machine to and fro along the feed beam (4), characterized in that the feed line (51) is routed over two outer sheaves (52, 53) that are arranged at each end (41, 42) of the feed beam (4) and in that a measuring device (7) that measures a location of the drilling machine (5) relative to the feed beam (4) for measuring the depth of penetration of said drill point during drilling operations and which measures a location of the drilling machine (5) relative to the feed beam (4) during adjustment of a size of the drill string is arranged to the shaft (9) of one of the outer sheaves (52, 53) and that this sheave (52, 53) and the shaft (9) are arranged such that they rotate together, said drilling machine being coupled to a proximal end of said drill string so that said measuring device directly measures the location of said proximal end of said drill string relative to said feed beam.

2. Rock drilling device according to claim 1, characterized in that the measuring device (7) is arranged to the sheave (52) at the rear end (42) of the feed beam (4).

3. Rock drilling device according to claim 2, characterized in that the shaft (9) is carried in two bearings (92, 93) placed near its ends.

4. Rock drilling device according to claim 2, characterized in that the measuring device (7) is arranged on an extension (91) of the shaft (9).

5. Rock drilling device according to claim 2, characterized in that a second sheave (92) over which a second feed line passes is arranged on the same shaft (9).

6. Rock drilling device according to claim 2, characterized in that the measuring device (7) is shielded by a protection plate (8) and in that a cable (71) that leads from the measuring device passes through the protection plate (8).

7. Drill rig comprising a rock drilling device according to claim 2.

8. Rock drilling device according to claim 1, characterized in that the shaft (9) is carried in two bearings (92, 93) placed near its ends.

9. Rock drilling device according to claim 8, characterized in that the measuring device (7) is arranged on an extension (91) of the shaft (9).

10. Rock drilling device according to claim 8, characterized in that a second sheave (92) over which a second feed line passes is arranged on the same shaft (9).

11. Drill rig comprising a rock drilling device according to claim 8.

12. Rock drilling device according to claim 1, characterized in that the measuring device (7) is arranged on an extension (91) of the shaft (9).

13. Drill rig comprising a rock drilling device according to claim 12.

14. Rock drilling device according to claim 1, characterized in that a second sheave (92) over which a second feed line passes is arranged on the same shaft (9).

15. Rock drilling device according to claim 5, characterized in that the second sheave (92) is arranged to the shaft via a bearing (95) such that the second sheave rotates independently of the shaft (9).

16. Drill rig comprising a rock drilling device according to claim 15.

17. Drill rig comprising a rock drilling device according to claim 14.

18. Rock drilling device according to claim 1, characterized in that the measuring device (7) is shielded by a protection plate (8) and in that a cable (71) that leads from the measuring device passes through the protection plate (8).

19. Drill rig comprising a rock drilling device according to claim 18.

20. Drill rig comprising a rock drilling device according to claim 1.

* * * * *

UNITED STATES PATENT AND TRADEMARK OFFICE

CERTIFICATE OF CORRECTION

PATENT NO. : 8,579,045 B2
APPLICATION NO. : 11/793260
DATED : November 12, 2013
INVENTOR(S) : Rene Deutsch et al.

It is certified that error appears in the above-identified patent and that said Letters Patent is hereby corrected as shown below:

In the Claims

Column 5, Line 17 (Claim 15, Line 1): Delete "claim 5" and substitute --claim 14--.

Signed and Sealed this
Twenty-eighth Day of January, 2014

Michelle K. Lee

Michelle K. Lee
*Deputy Director of the United States Patent and Trademark Office*